United States Patent [19]

Shepard et al.

[11] Patent Number: 4,560,080

[45] Date of Patent: Dec. 24, 1985

[54] REINFORCED STRUCTURE FOR STEEL ENDS OF CYLINDRICAL SHIPPING CONTAINERS

[75] Inventors: John K. Shepard, Bolingbrook; Carl Roberson, Downers Grove, both of Ill.

[73] Assignee: The Continental Group, Inc., Stamford, Conn.

[21] Appl. No.: 252,718

[22] Filed: Apr. 10, 1981

[51] Int. Cl.[4] ..... B65D 8/08; B65D 8/18

[52] U.S. Cl. ..... 220/67; 220/66

[58] Field of Search ..... 220/66, 67, 1 BC, 5 R

[56] References Cited

U.S. PATENT DOCUMENTS

| | | | |
|---|---|---|---|
| Re. 3,757 | 12/1869 | Green et al. | 220/72 |
| 1,422,043 | 4/1922 | Draper | 220/67 |
| 1,680,535 | 8/1928 | Gary | 220/67 |
| 1,910,426 | 5/1933 | Courtright | 220/73 X |
| 1,963,795 | 6/1934 | Lans | 220/66 |
| 1,987,817 | 1/1935 | Burns | 220/66 |
| 2,012,213 | 8/1935 | Young | 220/231 X |
| 2,117,180 | 5/1938 | Kronquest | 220/1 BC X |
| 2,810,492 | 10/1957 | Bergen et al. | 220/67 X |
| 2,971,671 | 2/1961 | Shakman | 220/66 |
| 3,160,312 | 12/1964 | Johnston | 220/67 |
| 3,339,793 | 9/1967 | Gerlovich | 220/66 |
| 3,814,279 | 6/1974 | Rayzal | 220/67 X |
| 3,878,963 | 4/1975 | Knize | 220/66 |
| 3,907,152 | 9/1975 | Wessely | 220/66 |

FOREIGN PATENT DOCUMENTS

| | | | |
|---|---|---|---|
| 268299 | 1/1964 | Australia . | |
| 802327 | 12/1950 | Fed. Rep. of Germany . | |
| 339732 | 6/1904 | France . | |
| 1512490 | 2/1968 | France . | |
| 613588 | 12/1960 | Italy . | |
| 5488 | of 1894 | United Kingdom | 220/66 |
| 1212519 | 11/1970 | United Kingdom | 220/67 |

*Primary Examiner*—Allan N. Shoap

*Attorney, Agent, or Firm*—Charles E. Brown

[57] ABSTRACT

This relates to an end, preferably a bottom end, for a metal shipping container wherein the end panel is recessed so as to bear the weight of the product shipped within the container. The invention particularly relates to the reinforcing of the end panel by an annular rib formed in the radially outer part of the end panel near to but spaced from the seam which joins the end to a container body. The annular rib is concentric to the container and is axially downwardly offset so as to be axially upwardly opening. The reinforcing rib is of a preferred depth and width ratio with respect to one another and to the container diameter.

4 Claims, 3 Drawing Figures

REINFORCED STRUCTURE FOR STEEL ENDS OF CYLINDRICAL SHIPPING CONTAINERS

This invention relates in general to new and useful improvements in metal containers, and more particularly to an improved end for a metal shipping container or drum.

The bottom end of large metal shipping containers is generally so constructed wherein the end panel thereof is recessed within the bead which forms a part of the seam between the end and container body. As a result, during shipment the product packed within the drum is jostled and the end panel constantly flexes. This flexure of the end panel results in an undesired cracking of the end panel and the failure of the container end through the occurrence of such fatigue cracks.

In accordance with this invention, it is proposed to provide the end panel of such metal ends for metal shipping containers with a reinforcing rib. The reinforcing rib is an annular rib and is disposed near to but spaced radially inwardly from the outer periphery of the end panel. The annular rib is concentric to the end panel and is radially elongated as compared to its axial depth.

The reinforcing rib formed in accordance with this invention includes a lower substantially planar base and a pair of upstanding flanges, with the outer flange being of a greater height than the inner flange and being primarily of an axial extent while the inner flange is primarily of a radial extent.

With the above and other objects in view that will hereinafter appear, the nature of the invention will be more clearly understood by reference to the following detailed description, the appended claims, and the several views illustrated in the accompanying drawings.

IN THE DRAWINGS

Figure 1:
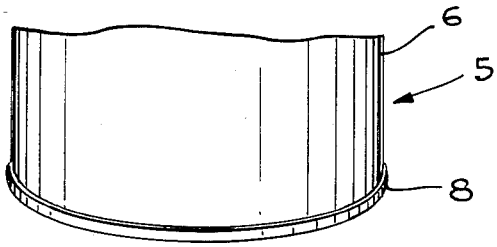
FIG. 1 is a fragmentary perspective view of the lower part of a metal shipping container having the lower end closed by a bottom end unit formed in accordance with this invention.
Figure 2:
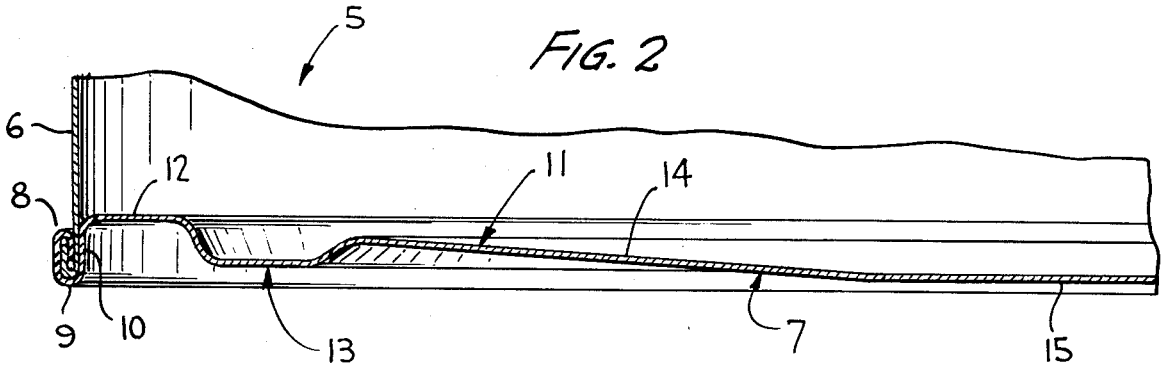
FIG. 2 is an enlarged fragmentary vertical sectional view taken through the extreme lower part of the container of FIG. 1, and shows the details of the container end.

Referring now to the drawings in detail, it will be seen that there is illustrated a metal shipping container 5 of the conventional type which includes a container body 6 and an end, generally identified by the numeral 7. The end 7 is connected to the body 6 by way of a conventional peripheral seam 8.

The end 7 includes a peripheral bead 9 which forms part of the seam 8. The bead 9 has an upstanding inner wall 10 from which there extends radially an end panel generally identified by the numeral 11.

This invention particularly relates to the configuration and proportions of the end panel 11.

The end panel 11 includes an outer planar annular portion 12 to which there is integrally joined an upwardly opening annular reinforcing rib 13. The end panel 11 also includes an intermediate portion 14 which is annular and which is joined to the radially inner edge of the bead 13. The intermediate end panel portion 14 slopes radially inwardly and axially downwardly. Finally, the end panel 11 includes a substantially flat circular central portion 15.

At this time it is pointed out that although the end panel 11 does slope generally axially downwardly toward its center, the central portion 15 is still spaced above the lower edge of the bead 9. Thus, the end panel 11 must support the weight of the contents of the container 5. It will be readily apparent that when the filled container 5 is shipped, as the vehicle carrying the container 5 is subjected to vertical displacements, there will be a vertical movement of the product with the result that the load on the end panel 11 will be diminished and then increases, causing a flexing of the metal of the end panel. It has been found that the reinforcing rib 13, due to its particular location, shape and dimensions, provides an adequate reinforcing of the end panel 11 without the requirement of metal. It has been found that the end 7, when subjected to vibratory tests simulating truck shipments of filled containers, will withstand more than five times the abuses of similar ends without this specific reinforcement.

Most specifically, it will be seen that the width of the reinforcing rib 13 is generally on the order of or slightly greater than the width of the outer end panel portion 12. It has been found that this specific location permits the required flexure of the end panel without unduly stressing the end panel.

Figure 3:
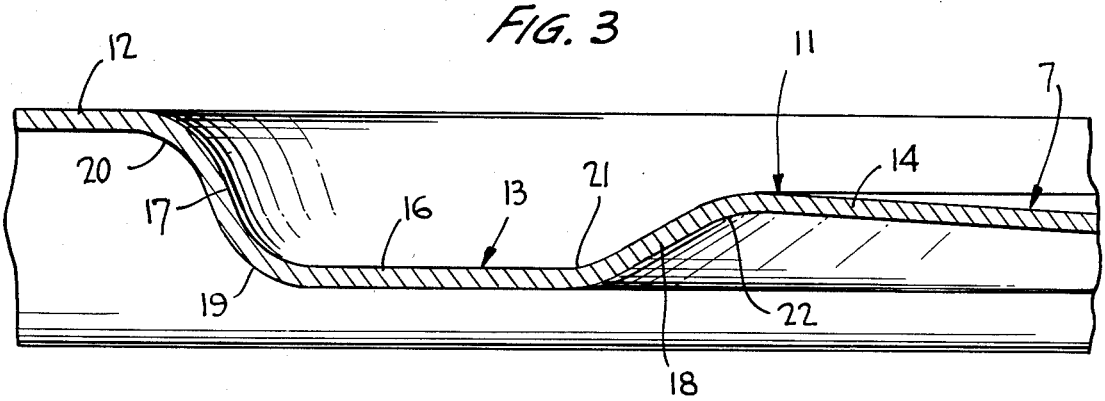
FIG. 3 is a further enlarged fragmentary vertical sectional view showing more specifically the details of the annular reinforcing rib.

With particular reference to FIG. 3, it will be seen that the reinforcing rib 13 includes a substantially planar base 16 which is offset axially downwardly from the general plane of the end panel 7 and which is defined by an outer flange 17 and an inner flange 18. The flange 17 is joined to the base 16 by a radius 19 and to the end panel portion 12 by a similar radius 20. The flange 17 slopes upwardly and radially outwardly at an angle on the order of 70° to the horizontal so that it is primarily an axial flange.

The inner flange 18 is joined to the base 16 by a radius 21 and to the intermediate end panel portion 14 by a radius 22 which are somewhat similar. The flange 18 is disposed at an angle on the order of 30° to the horizontal and thus primarily slopes radially.

It is to be noted that the effective height of the flange 18 is approximately only one-half the effective height of the flange 17. Thus the intermediate end panel portion 14 is axially offset with respect to the outer end panel portion 12.

It has been found that the most beneficial relationship of the axial width and vertical depth of the reinforcing rib 13 with respect to the diameter of the container 5 includes a width on the order of 1/15 the container diameter and a depth on the order of 1/80 of the container diameter.

The end which was tested had a diameter slightly greater than 22 inches and was formed of sheet steel having a thickness on the order of 0.048 inch.

Although only a preferred embodiment of the container end has been specifically illustrated and described herein, it is to be understood that minor variations may be made in the container end without departing from the spirit and scope of the invention as defined by the appended claims.

We claim:

1. A metal end for a shipping container, said end being circular in outline and having a peripheral flange portion for securement to a container body by the formation of a seam, said flange portion including an axially projecting bead including a generally cylindrical radially inner wall, and end panel integrally connected to an upper edge of said inner wall, said end panel in its unstressed state sloping radially inwardly and axially outwardly, and said end panel being reinforced by an integral axially downwardly and outwardly projecting annular rib disposed in close to but spaced relation to said inner wall, said annular rib being concentric with said inner wall and being of a radially elongated width in cross section as compared to its axial depth, the width of said annular rib being on the general order of the spacing of said annular rib from said inner wall.

2. A metal end for a shipping container, said end being circular in outline and having a peripheral flange portion for securement to a container body by the formation of a seam, said flange portion including an axially projecting bead including a generally cylindrical radially inner wall, an end panel integrally connected to an upper edge of said inner wall, said end panel in its unstressed state sloping radially inwardly and axially outwardly, and said end panel being reinforced by an integral axially downwardly and outwardly projecting annular rib disposed in close to but spaced relation to said inner wall, said annular rib being concentric with said inner wall and being of a radially elongated width in cross section as compared to its axial depth, the width of said annular rib being on the general order of the spacing of said annular rib from said inner wall but less.

3. A metal end for a shipping container, said end being circular in outline and having a peripheral flange portion for securement to a container body by the formation of a seam, said flange portion including an axially projecting bead including a generally cylindrical radially inner wall, an end panel integrally connected to an upper edge of said inner wall, said end panel in its unstressed state sloping radially inwardly and axially outwardly, and said end panel being reinforced by an integral axially downwardly and outwardly projecting annular rib disposed in close to but spaced relation to said inner wall, said annular rib being concentric with said inner wall and being of a radially elongated width in cross section as compared to its axial depth, said end panel between said inner wall and said annular rib being substantially planar.

4. An end according to claim 3 wherein said end panel includes a substantially planar central portion and a sloping intermediate portion between said annular rib and said central portion.

* * * * *